US009221087B2

(12) United States Patent
Yamane et al.

(10) Patent No.: US 9,221,087 B2
(45) Date of Patent: Dec. 29, 2015

(54) METHOD OF PRODUCING SEAMLESS METAL PIPE

(71) Applicant: NIPPON STEEL & SUMITOMO METAL CORPORATION, Tokyo (JP)

(72) Inventors: Kouji Yamane, Tokyo (JP); Tomio Yamakawa, Tokyo (JP); Kazuhiro Shimoda, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/353,038

(22) PCT Filed: Oct. 24, 2012

(86) PCT No.: PCT/JP2012/077494

§ 371 (c)(1),
(2) Date: Apr. 21, 2014

(87) PCT Pub. No.: WO2013/065553

PCT Pub. Date: May 10, 2013

(65) Prior Publication Data

US 2014/0250965 A1 Sep. 11, 2014

(30) Foreign Application Priority Data

Nov. 1, 2011 (JP) ..... 2011-240611

(51) Int. Cl.

| | |
|---|---|
| ***B21B 19/04*** | (2006.01) |
| ***B21B 23/00*** | (2006.01) |
| *B21B 19/06* | (2006.01) |

(52) U.S. Cl.
CPC ..... *B21B 19/04* (2013.01); *B21B 23/00* (2013.01); *B21B 19/06* (2013.01)

(58) Field of Classification Search
CPC ..... B21B 19/04; B21B 19/06; B21B 19/10; B21B 23/00; B21B 45/004
See application file for complete search history.

(56) References Cited

U.S. PATENT DOCUMENTS 7,308,812 B2 * 12/2007 Iida et al. ..... 72/42

FOREIGN PATENT DOCUMENTS

| | | |
|---|---|---|
| JP | 64-27707 | 1/1989 |
| JP | 04-187310 | 7/1992 |
| JP | 05-277516 | 10/1993 |
| JP | 10-128412 | 5/1998 |
| JP | 2001-219206 | 8/2001 |
| JP | 2002-239612 | 8/2002 |
| JP | 2008-161906 | 7/2008 |

* cited by examiner

*Primary Examiner* — Debra Sullivan
(74) *Attorney, Agent, or Firm* — Clark & Brody

(57) ABSTRACT

A method of producing a seamless metal pipe, which can suppress the occurrence of inner surface flaws, is provided. A method of producing a seamless metal pipe according to an embodiment of the present invention includes the steps of: heating a high alloy billet BL containing, by mass %, Cr: 20 to 30% and Ni: more than 22% and not more than 60% in a heating furnace F1 (S2); piercing-rolling the high alloy billet BL heated in the heating furnace F1 with a piercing machine P1 to produce a hollow shell (S3); cooling the hollow shell and then reheating the hollow shell in the heating furnace F1 (S4); and elongation-rolling the heated hollow shell with the piercing machine P1 (S5).

4 Claims, 6 Drawing Sheets

METHOD OF PRODUCING SEAMLESS METAL PIPE

TECHNICAL FIELD

The present invention relates to a method of producing a seamless metal pipe.

BACKGROUND ART

Examples of the method of producing a seamless metal pipe include the Ugine Sejournet process based on a press method and the Mannesmann process based on a skew rolling method.

In the Ugine Sejournet process, a hollow round billet in which a through hole is formed at its axial center by machining or piercing press is prepared. Then, the hollow round billet is subjected to hot extrusion by use of an extrusion apparatus to produce a seamless metal pipe.

In the Mannesmann process, a round billet is piercing-rolled with a piercing machine to produce a hollow shell. The produced hollow shell is elongation-rolled with a rolling mill to reduce the diameter and/or thickness of the hollow shell, thus producing a seamless pipe. Examples of the rolling mill include a plug mill, a mandrel mill, a Pilger mill, a sizer, and the like.

The Ugine Sejournet process can process the round billet at a high reduction rate, and therefore is excellent in pipe workability. A high alloy generally has a high deformation resistance. Therefore, a seamless metal pipe made of a high alloy is usually produced by the Ugine Sejournet process.

However, the manufacturing efficiency of the Ugine Sejournet process is lower than that of the Mannesmann process. Further, it is difficult for the Ugine Sejournet process to produce a large diameter pipe and a long pipe. In contrast, the Mannesmann process has high manufacturing efficiency and is capable of producing large diameter pipes and long pipes. Therefore, to produce a seamless metal pipe made of a high alloy, it is preferable to employ the Mannesmann process than the Ugine Sejournet process.

However, inner surface flaws attributed to lamination defects may occur in the inner surface of a high-alloy seamless metal pipe produced by the Mannesmann process. The lamination defect is caused by the melting of a grain boundary within the wall (in a central part of the wall thickness) of the hollow shell. As described above, a high alloy has a high deformation resistance, and further when the Ni content of the high alloy is high, solidus temperatures in the phase diagram thereof are low. When such a high alloy is piercing-rolled with a piercing machine, due to high deformation resistance thereof, work-induced heat will increase accordingly. Such work-induced heat causes a portion in the billet being piercing-rolled where temperature becomes close to or exceeds the melting point of the billet. In such a portion, the grain boundary melts, and a crack occurs. Such a crack is referred to as a lamination defect. Therefore, inner surface flaws attributed to lamination defects are likely to occur in a seamless metal pipe made of a high alloy.

Techniques to suppress the occurrence of inner surface flaws are proposed in JP2002-239612A (Patent Document 1), JP5-277516A (Patent Document 2), and JP4-187310A (Patent Document 3).

Patent Documents 1 and 2 disclose the following matters. Patent Documents 1 and 2 have an object to produce a seamless steel pipe made of austenitic stainless steel such as SUS304 etc. In Patent Documents 1 and 2, the starting material is formed into a hollow shell by machining and charged into a heating furnace. Then, the heated hollow shell is elongation-rolled with a piercing machine. The amount of reduction when a hollow shell is piercing-rolled is smaller compared with the case of a solid round billet. Therefore, the amount of work-induced heat decreases, lamination defects are reduced, and therefore the occurrence of inner surface flaws is suppressed.

Patent Document 3 discloses the following matters. Patent Document 3 adopts a production method based on a so-called "double-piercing" method in which two piercing machines (first and second piercing machines) are utilized in the Mannesmann process. Patent Document 3 has its object to suppress the occurrence of inner surface flaws of the hollow shell in the second piercing machine (elongator). In Patent Document 3, the roll inclination angle and the elongation ratio of an elongator are adjusted to reduce the rolling load of the elongator. As a result, the occurrence of inner surface flows is suppressed. Other related literatures include JP64-27707A.

DISCLOSURE OF THE INVENTION

However, in both Patent Documents 1 and 2, a billet is formed into a hollow shell by machining. Since the cost of producing a hollow shell by machining is high, the production cost of a seamless metal pipe becomes high. Further, when the hollow shell is produced by machining, the manufacturing efficiency will deteriorate.

In Patent Document 3, the rolling load of the second piercing machine is reduced by adjusting the roll inclination angle and the elongation ratio of the second piercing machine. However, inner surface flaws attributed to lamination defects may still occur. Further, Patent Document 3 is directed to austenitic stainless steel represented by SUS316 etc., in which Ni and Cr contents are low.

It is an object of the present invention to provide a method of producing a seamless metal pipe made of a high alloy which can suppress the occurrence of inner surface flaws.

A method of producing a seamless metal pipe according to an embodiment of the present invention includes the steps of: heating a high alloy billet containing, by mass %, Cr: 20 to 30% and Ni: more than 22% and not more than 60% in a heating furnace; piercing-rolling the heated high alloy billet with a piercing machine to produce a hollow shell; cooling the hollow shell and then reheating the hollow shell in the heating furnace; and elongation-rolling the heated hollow shell with the piercing machine.

The method of producing a seamless metal pipe made of a high alloy according to the present embodiment can suppress the occurrence of inner surface flaws.

BEST MODE FOR CARRYING OUT THE INVENTION

Figure 1:
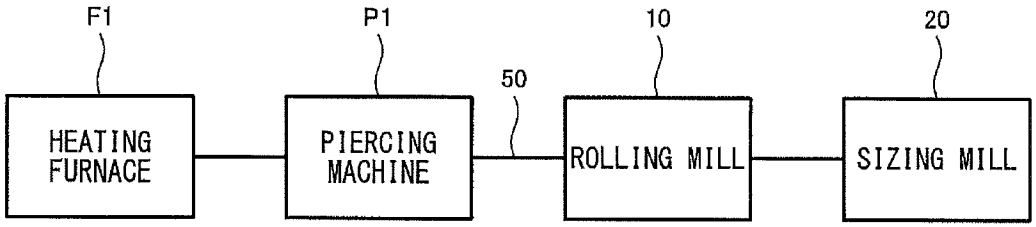
FIG. 1 is a general block diagram of a production line of a seamless metal pipe according to an embodiment of the present invention.

Hereafter, referring to the drawings, embodiments of the present invention will be described in detail. The same or corresponding parts in the drawings are denoted by the same reference characters so that the description thereof will not be repeated.

When producing a high-alloy seamless metal pipe by the Mannesmann process, a double-piercing method is suitable. A high alloy has high deformation resistance. For that reason, when the reduction rate per one piercing rolling is high, the load against the piercing machine becomes excessively larger compared with the case of general steels (such as low alloy steel). Further, since a higher reduction rate leads to larger work-induced heat, lamination defects become more likely to occur. Exploiting a double-piercing method will make it possible to keep the reduction rate per one piercing-rolling (elongation-rolling) down.

A production line of a conventional double-piercing method includes a heating furnace, and a first and a second piercing machines (elongators) as shown in Patent Document 3. A round billet heated in the heating furnace is piercing-rolled with the first piercing machine to be produced into a hollow shell. The hollow shell produced with the first piercing machine is quickly conveyed to the second piercing machine, and is elongation-rolled with the second piercing machine.

As described so far, in such a conventional double-piercing method, there is a case where inner surface flaws occur in the hollow shell in the second piercing machine. Accordingly the present inventors studied a method of suppressing work-induced heat when producing a high-alloy seamless metal pipe by a double-piercing method. As a result, the present inventors have obtained the following findings.

The hollow shell after piercing-rolling has a temperature distribution in the thickness direction. The inner surface of the hollow shell during piercing-rolling is in contact with the plug thereby being subjected to heat dissipation, and the outer surface of the hollow shell is in contact with the skew roll thereby being subjected to heat dissipation. On the other hand, the temperature within the wall of the hollow shell (a center part of the wall thickness of the hollow shell) increases due to work-induced heat. Therefore, the temperatures of the inner surface and the outer surface of the hollow shell decrease, and the temperature within the wall becomes highest. In particular, since the size of the skew roll is large, the outer surface temperature becomes lower than the inner surface temperature in the hollow shell due to heat dissipation. Therefore, a temperature difference between the temperatures within the wall and at the outer surface becomes maximum. Hereafter, the temperature difference between the temperatures within the wall and at the outer surface of the hollow shell is referred to as "temperature deviation".

When a hollow shell having large temperature deviation is elongation-rolled, a lamination defect becomes likely to occur. As the reason of which, the following matters are assumed. Temperature deviation causes local concentration of strain within the wall of the hollow shell during elongation-rolling. Such concentration of strain remarkably increases the work-induced heat within the wall, consequently causing lamination defects. Temperature deviation occurs during the piercing-rolling by the first piercing machine, and remains even after the hollow shell is conveyed from the first piercing machine to the second piercing machine.

Accordingly, in the present embodiment, the hollow shell produced by piercing-rolling is sufficiently cooled. Then, the cooled hollow shell is charged into the heating furnace again to be heated. In this case, in the cooled hollow shell, temperature deviation is eliminated or remarkably decreased. Therefore, even when the hollow shell is reheated, temperature deviation in the hollow shell is suppressed. Thus, the occurrence of lamination defects attributed to temperature deviation as in the conventional double-piercing method is restrained.

In the cooling of the hollow shell, it is sufficient that the hollow shell is cooled until the within-the-wall temperature of the hollow shell produced by piercing-rolling becomes lower than the heating temperature during reheating. When the outer surface temperature of the hollow shell is not more than 900° C., the within-the-wall temperature of the hollow shell will be not more than 1100° C., thus being not more than the heating temperature during reheating. As a result of that, temperature deviation is eliminated. Therefore, it is sufficient if the hollow shell is cooled until the outer surface temperature thereof becomes not more than 900° C. before reheating.

When the cooled hollow shell is reheated in the heating furnace, there is possibility that scale is produced on the inner surface and the outer surface of the hollow shell. If the hollow shell is elongation-rolled with scale adhering to the inner surface, there is possibility that inner surface flaws attributed to the scale on the inner surface (referred to as "inside scabs") are formed. However, when the chemical composition of the hollow shell contains at least Cr: 20 to 30% and Ni: more than 22% and not more than 60%, the oxidation resistance of the hollow shell will be very high. For that reason, scale is not likely to be produced on the inner surface of the hollow shell during heating. Thus, if the hollow shell has the above described chemical composition, the occurrence of inner surface flaws attributed to scale will be suppressed.

Based on the findings as described above, the present inventors have completed the following method of producing a seamless metal pipe.

A method of producing a seamless metal pipe according to the present embodiment includes the steps of: heating a high alloy billet containing, by mass %, Cr: 20 to 30% and Ni: more than 22% and not more than 60% in a heating furnace; piercing-rolling the heated high alloy with a piercing machine to produce a hollow shell; cooling the hollow shell and then reheating the hollow shell with the heating furnace; and elongation-rolling the heated hollow shell with the piercing machine.

In the present embodiment, the cooled hollow shell is reheated in the heating furnace. In the cooled hollow shell, temperature deviation is small or is eliminated. For that reason, in the reheated hollow shell, temperature deviation is substantially suppressed. Therefore, lamination defects are not likely to occur in elongation-rolling. Further, since the hollow shell has high Cr and Ni contents, and is excellent in oxidation resistance, scale is not likely to be produced on inner surface of the hollow shell during reheating. Therefore, it is possible to suppress the occurrence of inner surface flaws in a produced seamless metal pipe.

In the step of heating the hollow shell, preferably, the hollow shell which has been cooled to not more than 900° C. in the outer surface temperature is heated.

In this case, temperature deviation in the hollow shell can be substantially eliminated.

Preferably, in the step of piercing-rolling, a piercing ratio defined by Formula (1) is from 1.1 to not more than 2.0; and in the step of elongation-rolling, an elongation ratio defined by Formula (2) is from 1.05 to not more than 2.0, and a total elongation ratio defined by Formula (3) is more than 2.0.

Piercing ratio=hollow shell length after piercing-rolling/billet length before piercing-rolling (1)

Elongation ratio=hollow shell length after elongation-rolling/hollow shell length before elongation-rolling (2)

Total elongation ratio=hollow shell length after elongation-rolling/billet length before piercing-rolling (3)

In this case, a high-alloy seamless metal pipe can be produced at a high reduction rate (total elongation ratio).

Hereafter, details of the method of producing a seamless metal pipe according the present embodiment will be described.

[Production Facility]

FIG. 1 is a block diagram showing an example of a production line of a seamless metal pipe according to the present embodiment.

Referring to FIG. 1, the production line includes a heating furnace F1, a piercing machine P1, and a rolling mill (an elongation-rolling mill 10 and a sizing mill 20 in the present example). A conveyance system 50 is disposed between each facility. The conveyance system 50 is, for example, a conveyor roller, a pusher, a walking beam type conveyance system, and the like. The elongation-rolling mill 10 is, for example, a mandrel mill. The sizing mill 20 is, for example, a sizer or a reducer.

Figure 2:
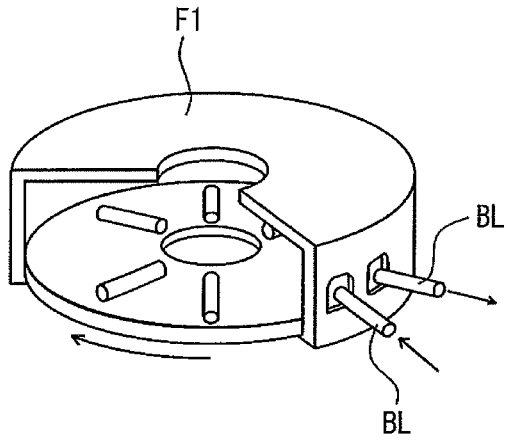
FIG. 2 is a schematic diagram of a heating furnace in FIG. 1.

The heating furnace F1 accommodates and heats the round billet. The heating furnace F1 further accommodates and heats the hollow shell produced with the piercing machine P1. In short, the heating furnace F1 heats not only the round billet, but also the hollow shell. The heating furnace F1 has a well-known configuration. The heating furnace F1 may be, for example, a rotary hearth furnace shown in FIG. 2, or may be a walking beam furnace.

The piercing machine P1 piercing-rolls a round billet BL (see FIG. 2) withdrawn from the first furnace F1 to produce a hollow shell. The piercing machine P1 further elongation-rolls the hollow shell which has been heated with the heating furnace F1. The piercing machine P1, in short, plays the role of the first and second piercing machines in a conventional double-piercing method.

Figure 3:
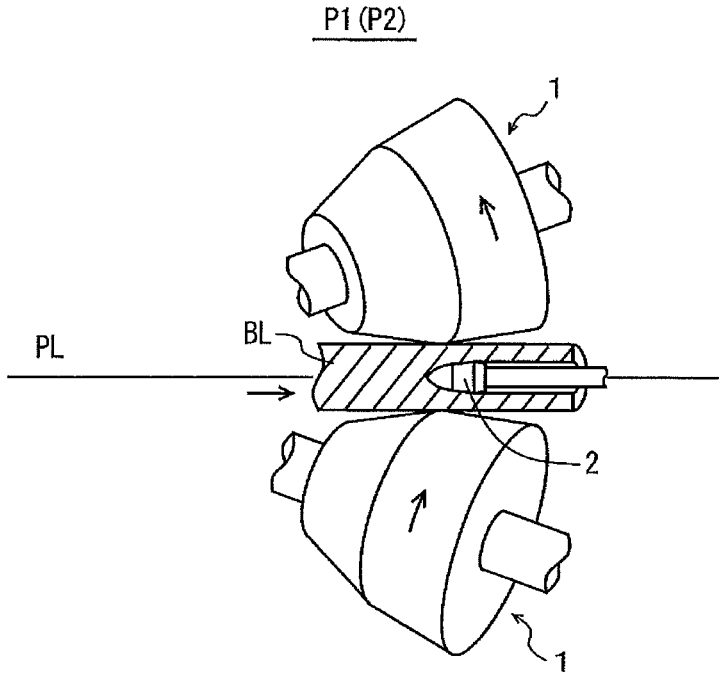
FIG. 3 is a schematic diagram of a piercing machine in FIG. 1.

FIG. 3 is a schematic diagram of the piercing machine P1. Referring to FIG. 3, the piercing machine P1 includes a pair of skew rolls 1 and a plug 2. The pair of skew rolls 1 are disposed on either side of a pass line PL so as to oppose to each other. Each skew roll 1 has an inclination angle and a crossing angle with respect to the pass line PL. The plug 2 is disposed between the pair of skew rolls 1 and on the pass line PL. Although a pair of skew rolls are disposed in FIG. 3, three or more skew rolls may be disposed. The skew roll may be a cone type or a barrel type.

[Production Flow]

Figure 4:
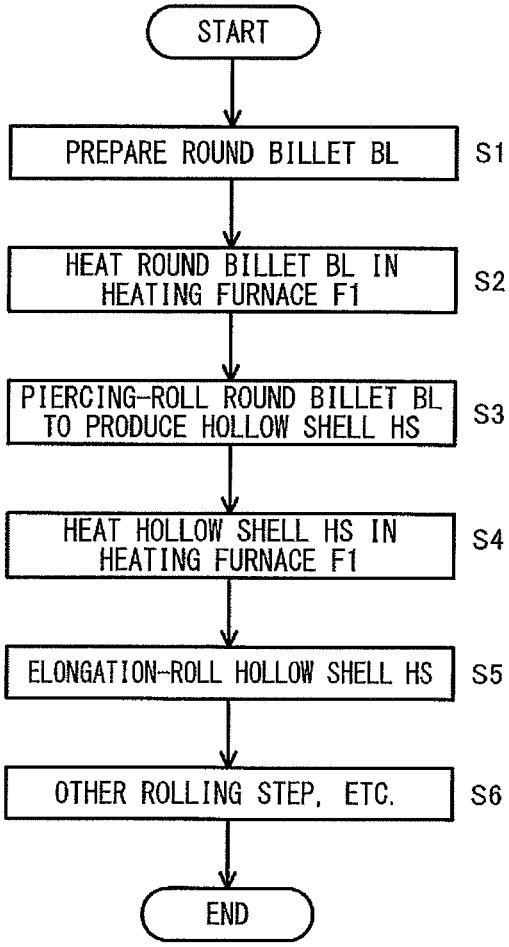
FIG. 4 is a flowchart showing production steps of a seamless metal pipe according to the present embodiment.

FIG. 4 is a flowchart showing production steps of a seamless metal pipe according to the present embodiment. The method of producing a seamless metal pipe according to the present embodiment performs the following steps. First, a high-alloy round billet BL is prepared (S1: preparation step). The prepared round billet BL is charged into the heating furnace F1 to be heated (S2: initial heating step). The heated round billet BL is piercing-rolled with the piercing machine P1 to produce a hollow shell HS (S3: piercing-rolling step). The hollow shell HS is cooled and then the cooled hollow shell HS is reheated in the heating furnace F1 (S4: reheating step). The heated hollow shell HS is elongation-rolled with a piercing machine P1 (S5: elongation-rolling step). The elongation-rolled hollow shell HS is rolled with the elongation-rolling mill 10 and the sizing mill 20 to be formed into a seamless metal pipe (S6). Hereafter, each step will be described in detail.

[Preparation Step (S1)]

First, a round billet made of a high alloy (high alloy billet) is prepared. The round billet contains at least 20 to 30% of Cr, and more than 22% and not more than 60% of Ni. Preferably, the round billet contains C: 0.005 to not more than 0.04%, Si: 0.01 to not more than 1.0%, Mn: 0.01 to 5.0%, P: not more than 0.03%, S: not more than 0.03%, Cr: 20 to 30%, Ni: more than 22% and not more than 60%, Cu: 0.01 to 4.0%, Al: 0.001 to 0.3%, N: 0.005 to 0.5%, the balance being impurities and Fe. Moreover, as needed, the round billet may contain, in place of part of Fe, one or more kinds of Mo: not more than 11.5% and W: not more than 20%. Further, the round billet may contain, in place of part of Fe, one or more kinds of Ca: not more than 0.01%, Mg: not more than 0.01%, Ti: 0.001 to 1.0%, V: 0.001 to 0.3%, Nb: 0.0001 to 0.5%, Co: 0.01 to 5.0%, and REM: not more than 0.2%.

For example, the round billet is produced by the following known method. Molten steel having the above described chemical composition is produced. The molten steel is formed into an ingot by an ingot-making process. Alternatively, the molten steel is formed into a slab or a bloom by a continuous casting process. The ingot, the slab or the bloom is subjected to hot working to produce a round billet. The hot working is, for example, hot forging. The high-alloy round billet may be produced by the continuous casting process. Moreover, the high-alloy round billet may be produced by any method other than the above described methods.

The seamless metal pipe of the present embodiment is directed to a high alloy having the above described chemical composition. Since the high alloy having the above described chemical composition has high Cr and Ni contents, it is excellent in oxidation resistance. Therefore, scale is not likely to be produced during heating in the heating furnace F1.

[Initial Heating Step (S2)]

The prepared round billet BL is charged into the heating furnace F1 to be heated. Preferable heating temperature is 1150 to 1250° C. When the round billet BL is heated in this temperature range, it is not likely that grain boundary melting occurs in the round billet BL during piercing-rolling. The upper limit of preferable heating temperature is not more than 1220° C. The heating time is not particularly limited.

[Piercing-Rolling Step (S3)]

The round billet BL heated in the heating furnace F1 is piercing-rolled with the piercing machine P1. More specifically, the round billet BL is withdrawn from the heating furnace F1. The withdrawn round billet BL is quickly conveyed to the entrance side of the piercing machine P1 by the conveyance system 50 (a conveyor roller, pusher, etc.). Then, the round billet BL is piercing-rolled with the piercing machine P1 to produce a hollow shell HS.

A preferable piercing ratio in the piercing-rolling is from 1.1 to not more than 2.0. The piercing ratio is defined by the following Formula (1):

$$\text{Piercing ratio} = \text{Hollow shell length after piercing-rolling}/\text{Billet length before piercing-rolling} \quad (1)$$

When the piercing-rolling is performed within the above described range of the piercing ratio, lamination defects are not likely to occur. Further, when the heating temperature of the heating furnace F1 is less than 1100° C., the load in the piercing machine P1 becomes excessively large, and thereby piercing-rolling becomes difficult.

As the heating temperature increases, a lamination defect occurs at a lower piercing ratio. When the sum of the heating temperature of the round billet and the work-induced heat due to piercing-rolling exceeds the grain boundary melting temperature specific to the material, a lamination defect will occur. The work-induced heat decreases as the piercing ratio decreases. Therefore, as the heating temperature increases, a smaller piercing ratio is preferred.

[Reheating Step (S4)]

The within-the-wall temperature of the hollow shell immediately after piercing-rolling is remarkably higher than the outer surface temperature of the hollow shell. As described above, a value obtained by subtracting the temperature of the outer wall of the hollow shell from the temperature within-the-wall (at a center position of wall thickness) in a cross section (a section perpendicular to the axial direction of the hollow shell) of the hollow shell is defined as "temperature deviation" (° C.).

Figure 5:
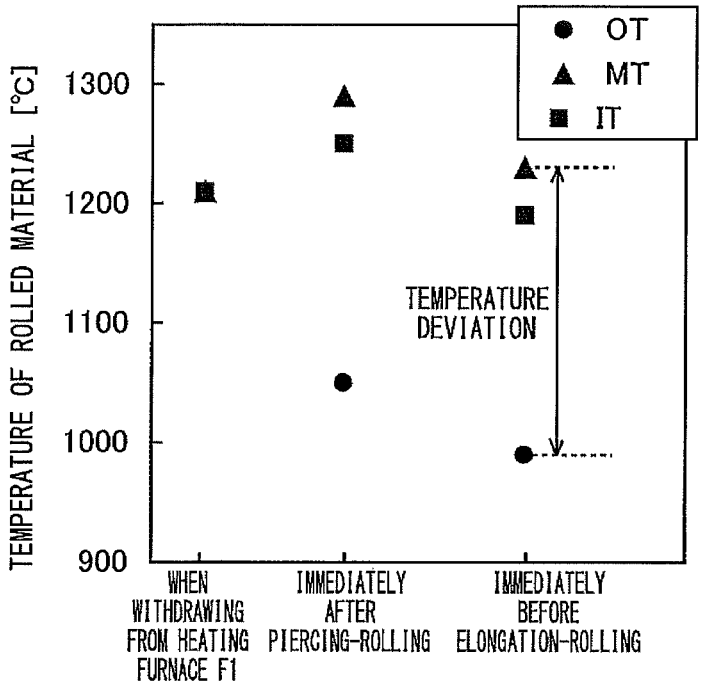
FIG. 5 is a diagram showing the transition of temperatures at inner surface and outer surface, and within the wall of the hollow shell at each step, when the hollow shell is elongation-rolled with a second piercing machine without being reheated after being piercing-rolled with a first piercing machine.

FIG. 5 is a diagram showing the transition of the inner surface temperature, the outer surface temperature, and the within-the-wall temperature of the hollow shell at each step (at the time of withdrawing from the heating furnace, immediately after piercing-rolling with the first piercing machine, and immediately before elongation-rolling with the second piercing machine) in a conventional double-piercing method using the first and second piercing machines. FIG. 5 was obtained by the following numerical analysis.

Figure 6A:
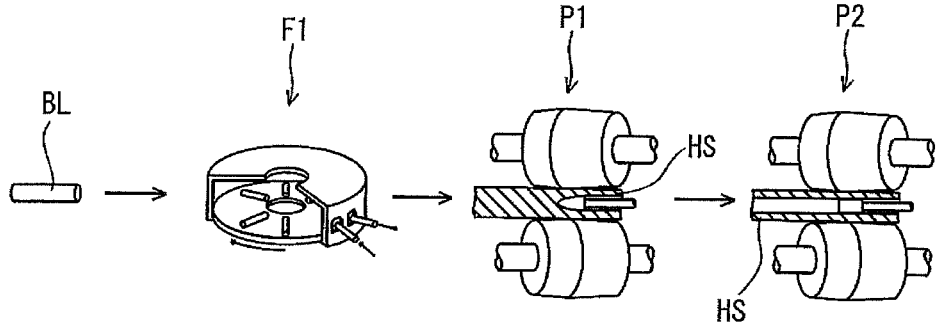
FIG. 6A PRIOR ART
FIG. 6A is a schematic diagram showing production steps of a seamless metal pipe according to a conventional double-piercing method.

FIG. 6A is a schematic diagram of production steps of a conventional double-piercing method used in the numerical analysis of FIG. 5. Referring to FIG. 6A, in the conventional double-piercing method, the billet BL is charged into the heating furnace F1 and heated. The heated billet BL is piercing-rolled with the first piercing machine P1 to produce a hollow shell HS. The hollow shell HS is quickly conveyed to the second piecing machine P2 without being heated, and is elongation-rolled with the second piercing machine P2. The temperature transitions of the round billet and the hollow shell in the above described production steps were determined.

To be more specific, a round billet BL made of a high alloy satisfying the above described chemical composition was assumed. The round billet BL was supposed to have an outer diameter of 70 mm and a length of 500 mm. The heating temperature of the heating furnace F1 was supposed to be 1210° C. It was also supposed that the hollow shell HS to be produced by piercing rolling with the piercing machine P1 had an outer diameter of 75 mm, a wall thickness of 10 mm, and a length of 942 mm. The piercing ratio was 1.88. The conveyance time to convey the hollow shell HS from the piercing machine P1 to the piercing machine P2 was supposed to be 60 seconds.

Based on the above described production conditions, a numerical analysis model was constructed. Then, outer surface temperature OT, inner surface temperature IT, and within-the-wall temperature (temperature at a center position of the wall thickness) MT of the hollow shell HS (or the round billet BL) were determined by a difference method. Based on each determined temperature, FIG. 5 was created.

MT ("▲" mark) in FIG. 5 indicates the within-the-wall temperature. IT ("■" mark) indicates the inner surface temperature. OT ("●" mark) indicates the outer surface temperature. Referring to FIG. 5, temperature deviation (difference value between the within-the-wall temperature MT and the outer surface temperature OT) immediately after the piercing-rolling was not less than 200° C., and the within-the-wall temperature MT was not less than 1280° C. Moreover, the temperature deviation amount immediately before elongation-rolling, that is, at the entrance side of the second piercing machine, was not less than 230° C. and the within-the-wall temperature MT was not less than 1230° C. That is, due to work-induced heat, the within-the-wall temperature MT became higher than the heating temperature of the heating furnace F1.

From the analysis described above, it was estimated that the temperature deviation of the hollow shell after piercing-rolling in the conventional double-piercing method be about 100 to 230° C. Thus, in the conventional double-piercing method, a hollow shell having such a large temperature deviation is elongation-rolled with the second piercing machine. In this case, strain will locally concentrate within the wall due to the temperature deviation, and work-induced heat will remarkably increase. The increase in the work-induced heat becomes more remarkable as the temperature deviation increases. Therefore, if elongation-rolling is performed with the second piercing machine P2 while the temperature deviation in the hollow shell remains large, lamination defects become more likely to occur in the hollow shell.

Figure 6B:
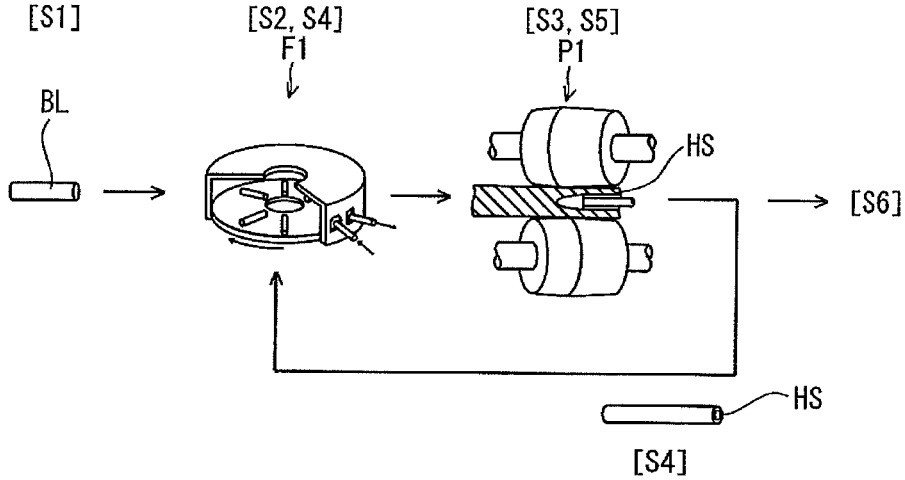
FIG. 6B is a schematic diagram showing production steps of a seamless metal pipe according to the present embodiment.

Accordingly, in the present embodiment, as shown in FIG. 6B, the hollow shell HS produced with the piercing machine P1 is sufficiently cooled (S4) so that the temperature deviation in the hollow shell HS is eliminated or suppressed to be low. Then, the cooled hollow shell HS is charged into the heating furnace F1 again and is heated as in the initial heating step in step S2 (S4). In this case, temperature deviation is not likely to occur in the heated hollow shell HS. Therefore, the occurrence of lamination defects due to work-induced heat is suppressed during elongation-rolling in the following step, and thus the occurrence of inner surface flaws is suppressed. A preferable heating temperature in the reheating step (S4) is from 1100° C. to 1250° C. A further preferable heating temperature in the reheating step (S4) is not less than 1150° C.

The method of cooling the hollow shell may be natural cooling or water cooling. The rate of cooling will not be particularly limited.

In the cooling of the hollow shell, if the within-the-wall temperature of the hollow shell HS produced by piercing-rolling becomes lower than the heating temperature in the reheating step (S4), temperature deviation in the hollow shell HS will be eliminated. A preferable temperature to stop cooling the hollow shell is not more than 900° C. in the outer surface temperature thereof. If the outer surface temperature of the hollow shell is not more than 900° C., the within-the-wall temperature thereof will become not more than 1100° C. Therefore, in this case, the within-the-wall temperature becomes not more than the heating temperature (1100° C. to 1250° C.) in the reheating step (S4).

The heating time in the reheating step (S4) may be the same as the heating time in the initial heating step (S2). Provided the material pipe is heated to a desired temperature in the reheating step, the heating time is not particularly limited.

As so far described, the hollow shell of the present embodiment is made of a high alloy having high Cr and Ni contents. Therefore, even if the hollow shell is heated in the reheating step (S4), scale is not likely to be produced on the inner surface and outer surface of the hollow shell. Therefore, the occurrence of inner surface flaws attributed to scale will be suppressed during elongation-rolling in the following step.

[Elongation-Rolling Step (S5)]

The hollow shell is withdrawn from the heating furnace F1 and is conveyed again to the piercing machine P1. As shown in FIG. 6B, the hollow shell HS is elongation-rolled by using the piercing machine P1 again.

A preferable elongation ratio in the elongation-rolling is from 1.05 to not more than 2.0. The elongation ratio is defined by the following Formula (2).

$$\text{Elongation ratio}=\text{Hollow shell length after elongation-rolling}/\text{hollow shell length before elongation-rolling} \quad (2)$$

The relationship between the heating temperature of the heating furnace F1 and the elongation ratio is the same as the relationship between the heating temperature of the heating furnace F1 and the piercing ratio in the piercing-rolling step (S3). A preferable elongation ratio is from 1.05 to 2.0.

Further, a total elongation ratio defined by Formula (3) is preferably more than 2.0 and not more than 4.0.

$$\text{Total elongation ratio}=\text{Hollow shell length after elongation-rolling}/\text{billet length before piercing-rolling} \quad (3)$$

In the present embodiment, the hollow shell HS produced by piercing-rolling is cooled to eliminate or decrease temperature deviation as shown in FIG. 6B. Then, the cooled hollow shell HS is charged into the heating furnace F1 again and is reheated. The reheated hollow shell is elongation-rolled by utilizing the piercing machine P1 again. In the case of the process steps described above, it is possible to suppress temperature deviation in the hollow shell HS before elongation-rolling compared with in the conventional double-piercing process shown in FIG. 6A. Therefore, it is possible to suppress the occurrence of lamination defects due to elongation-rolling. Further, since the hollow shell HS has high Cr and Ni contents, scale is not likely to be produced on the inner surface of the hollow shell HS when the hollow shell is reheated in the heating furnace F1. Therefore, inner surface flaws attributed to scale are not likely to occur during elongation-rolling even if the hollow shell HS is reheated.

EXAMPLES

A plurality of seamless metal pipes were produced based on various production methods, and investigation was made on whether or not an inner surface flaw occurred.

Inventive Example

Seamless metal pipes of Inventive Example were produced by the following method. Three round billets made of the high alloy containing, by mass %, C: 0.02%, Si: 0.3%, Mn: 0.6%, Cr: 25%, Ni: 31%, Cu: 0.8%, Al: 0.06%, N: 0.09%, and Mo: 3%, the balance being Fe and impurities were prepared. Each round billet had an outer diameter of 70 mm and a length of 500 mm. Each round billet was charged into the heating furnace F1 to be heated at 1210° C. for 60 minutes. After heating, the round billet was withdrawn from the heating furnace F1, and was piercing-rolled with the piercing machine P1 to be formed into a hollow shell. The hollow shell had an outer diameter of 75 mm, a wall thickness of 10 mm, and a length of 942 mm, and the piercing ratio was 1.88.

The hollow shell after piercing-rolling was allowed to cool. After the surface temperature of the hollow shell reached room temperature (25° C.), the hollow shell was charged into the heating furnace F1 and was reheated. The heating temperature during reheating was 1200° C. and heating was performed for sufficient time to bring the temperature of the hollow shell to 1200° C.

After the heating, the hollow shell was withdrawn from the heating furnace F1 and was elongation-rolled with the piercing machine P1 to produce a seamless metal pipe. The produced seamless metal pipe had an outer diameter of 86 mm, a wall thickness of 7 mm, and a length of 1107 mm, and the elongation ratio was 1.18. The total elongation ratio was 2.21.

The presence or absence of a lamination defect in each produced seamless metal pipe was investigated. To be specific, each seamless metal pipe was cut in the direction perpendicular to the axial direction, and the presence or absence of a lamination defect on the inner surface thereof was visually observed. When even one lamination defect was observed, it was judged that the lamination defect had occurred in the seamless metal pipe.

Further, investigation was made on the presence or absence of inside scabs (inner surface flaws) attributed to scale by visual observation on the inner surface of each produced seamless metal pipe over the entire length thereof.

Comparative Example 1

Seamless metal pipes of Comparative Example 1 were produced by the following method. Three round billets having the same chemical composition and dimensions as those of Inventive Example were prepared. The round billets were heated in the heating furnace F1 under the same condition as in Inventive Example. After heating, the round billets were piercing-rolled with the piercing machine P1 to produce seamless metal pipes having the same dimensions (outer diameter 86 mm, wall thickness 7 mm, and length 1107 mm) as those of Inventive Example. The piercing ratio was 2.21, which was the same as the total elongation ratio of Inventive Example. In short, in Comparative Example 1, the piercing ratio was made higher than 2.0 so that the seamless metal pipe was produced by one piercing-rolling (single piercing).

The presence or absence of lamination defects and inside scabs in each produced seamless metal pipe was investigated in the same manner as in Inventive Example.

Comparative Example 2

The seamless metal pipe of Comparative Example 2 was produced in the following manner. Three round billets having the same chemical composition and dimensions as those of Inventive Example were prepared. The round billets were heated in the heating furnace F1 under the same condition as in Inventive Example and were piercing-rolled with the piercing machine P1 to be formed into a hollow shell. The produced hollow shells had the same size as that of Inventive Example. The produced hollow shells were conveyed to the piercing machine P2 as they were without being charged into the heating furnace F1. Then, the hollow shells were elongation-rolled under the same condition as that in Inventive Example by using the piercing machine P2 to produce seamless metal pipes. In short, in Comparative Example 2, seamless metal pipes were produced by the same production steps (conventional double-piercing method) as in FIG. 6A. The outer surface temperature of the hollow shell at the entrance side of the piercing machine P2 was 990° C. The presence or absence of lamination defects and inside scabs in the produced seamless metal pipe was investigated by the same method as in Inventive Example.

Comparative Example 3

Seamless metal pipes of Comparative Example 3 were produced in the following method. Three round billets made of austenitic stainless steel corresponding to SUS304 specified in the JIS Standards were prepared. The dimensions of the round billet were the same as those of Inventive Example. Seamless metal pipes were produced by the same production steps (that is, the production steps of FIG. 6B) and under the same production condition as in Inventive Example. In short, in Comparative Example 3, seamless metal pipes were produced by using a starting material different from that of Inventive Example, and by the same production method as that of Inventive Example. The presence or absence of lamination defects and inside scabs in each produced seamless metal pipe was investigated in the same manner as in Inventive Example.

[Investigation Results]

Investigation results are shown in Table 1.

TABLE 1

| | Lamination defect | Inside scab |
|---|---|---|
| Inventive Example | NF | NF |
| Comparative Example 1 | F | NF |
| Comparative Example 2 | F | NF |
| Comparative Example 3 | NF | F |

In the "lamination defect" column in Table 1, "NR" indicates that no lamination defect was observed. "F" indicates that any lamination defect was observed. In the "inside scab" column, "NF" indicates that no inside scab was observed, and "F" indicates that any inside scab was observed.

Figure 7:
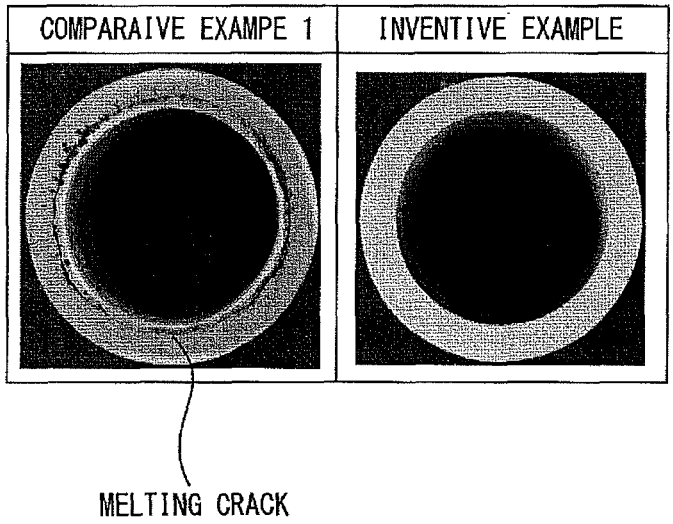
FIG. 7 shows a cross section photograph of a seamless metal pipe of Inventive Example produced by the production method of the present embodiment, and a cross section photograph of a seamless metal pipe of Comparative Example produced by the production method different from that of the present embodiment.

Moreover, the right column of FIG. 7 shows a cross-section photograph of a seamless metal pipe of Inventive Example, and the left column thereof shows that of a seamless metal pipe of Comparative Example 1.

Referring to Table 1 and FIG. 7, in Inventive Example, neither lamination defect nor inside scab was observed indicating that no inner surface flaw has occurred. On the other hand, in Comparative Example 1, lamination defects were observed in a portion near the inner surface as shown in FIG. 7. In Comparative Example 2 as well, lamination defects were observed. In Comparative Example 3, no lamination defect was observed. However, inside scabs were observed. Comparative Example 3 utilized a round billet having a chemical composition which is lower in Cr content and Ni content than that of the high-alloy billet according to the present embodiment. For that reason, it is considered that scale was formed on the inner surface of the hollow shell when the hollow shell was reheated, and due to the scale, inside scabs occurred in the inner surface of the seamless metal pipe.

While embodiments of the present invention have been described so far, the above described embodiments are merely illustrations to practice the present invention. Therefore, the present invention will not be limited to the above described embodiments, and can be practiced by appropriately modifying the above described embodiments within a range not departing from the spirit of the present invention.

The invention claimed is:

1. A method of producing a seamless metal pipe comprising the steps of:

heating a high alloy billet containing, by mass %, Cr: 20 to 30% and Ni: more than 22% and not more than 60% in a heating furnace;

piercing-rolling the heated high alloy billet with a piercing machine to produce a hollow shell, the piercing machine including a pair of skew rolls and a plug;

cooling the hollow shell after piercing rolling and then reheating the hollow shell in the heating furnace used for heating the high alloy billet; and elongation-rolling the heated hollow shell with the piercing machine used for piercing-rolling the heated high alloy billet.

2. The method of producing a seamless metal pipe according to claim 1, wherein in the step of piercing-rolling, a piercing ratio defined by Formula (1) is from 1.1 to not more than 2.0; and in the step of elongation-rolling, an elongation ratio defined by Formula (2) is from 1.05 to not more than 2.0, and a total elongation ratio defined by Formula (3) is more than 2.0:

piercing ratio=hollow shell length after piercing-rolling / billet length before piercing-rolling (1)

elongation ratio=hollow shell length after elongation-rolling/hollow shell length before elongation-rolling (2)

total elongation ratio=hollow shell length after elongation-rolling/billet length before piercing-rolling (3).

3. The method of producing a seamless metal pipe according to claim 1, wherein in the step of heating the hollow shell, the hollow shell which has been cooled to not more than 900° C. in the outer surface temperature is heated.

4. The method of producing a seamless metal pipe according to claim 3, wherein in the step of piercing-rolling, a piercing ratio defined by Formula (1) is from 1.1 to not more than 2.0; and in the step of elongation-rolling, an elongation ratio defined by Formula (2) is from 1.05 to not more than 2.0, and a total elongation ratio defined by Formula (3) is more than 2.0:

piercing ratio=hollow shell length after piercing-rolling/billet length before piercing-rolling (1)

elongation ratio=hollow shell length after elongation-rolling / hollow shell length before elongation-rolling (2)

total elongation ratio=hollow shell length after elongation-rolling/billet length before piercing-rolling (3).

* * * * *